United States Patent [19]

Koh

[11] Patent Number: 4,854,912

[45] Date of Patent: Aug. 8, 1989

[54] DOLL OF RUSH STALKS

[76] Inventor: Chang-Am Koh, Rm. No. 1107, 27-dong, Woosung Apt. 101-2, Jamsil-dong, Kangdong-ku, Seoul, Rep. of Korea

[21] Appl. No.: 577,809

[22] Filed: Feb. 7, 1984

[30] Foreign Application Priority Data

| | | | |
|---|---|---|---|
| Feb. 8, 1983 | [KR] | Rep. of Korea | 1118/83 |
| Mar. 30, 1983 | [KR] | Rep. of Korea | 2974/83 |
| Sep. 26, 1983 | [KR] | Rep. of Korea | 8345/83 |

[51] Int. Cl.[4] ..... A63H 3/46; A63H 3/36; A01N 1/00

[52] U.S. Cl. ..... 446/373; 446/385; 428/16

[58] Field of Search ..... 446/268, 373, 374, 385, 446/388, 369, 370, 331, 359, 366, 386; 428/16, 17, 18

[56] References Cited

U.S. PATENT DOCUMENTS

| | | | |
|---|---|---|---|
| D. 62,766 | 7/1923 | Zimmerman | 446/385 X |
| 585,092 | 6/1897 | Gibson | 446/388 |
| 1,141,459 | 6/1915 | Gregg | 446/370 |
| 1,208,029 | 12/1916 | Smith | 446/385 |
| 1,353,406 | 9/1920 | Lopez | 446/370 |
| 1,396,766 | 11/1921 | McClelland | 446/321 |
| 1,605,783 | 11/1926 | Rush | 446/385 |
| 1,612,805 | 1/1927 | Francke | 446/385 |
| 1,621,805 | 1/1927 | Francke | 446/385 |
| 1,640,260 | 8/1927 | Vogel | 446/268 |
| 1,683,561 | 9/1928 | Letson | 446/359 |
| 1,730,177 | 10/1929 | Van Cleave | 446/385 X |
| 2,090,499 | 8/1937 | Gustafsson | 446/385 X |
| 2,429,928 | 10/1947 | Exline | 446/321 |
| 3,722,070 | 3/1973 | Shiner | 446/385 X |

FOREIGN PATENT DOCUMENTS

| | | | |
|---|---|---|---|
| 7787 | 5/1912 | United Kingdom | 446/369 |
| 122100 | 11/1918 | United Kingdom | 446/374 |
| 206457 | 11/1923 | United Kingdom | 446/385 |
| 399824 | 4/1933 | United Kingdom | 446/374 |
| 418713 | 10/1934 | United Kingdom | 446/385 |
| 1502941 | 3/1978 | United Kingdom | 446/385 |
| 1585330 | 2/1981 | United Kingdom | 446/373 |
| 2135204 | 8/1984 | United Kingdom | 446/385 |

*Primary Examiner*—Robert A. Hafer
*Assistant Examiner*—D. Neal Muir
*Attorney, Agent, or Firm*—Antonelli, Terry & Wands

[57] ABSTRACT

A doll having an upper body section of rush stalks being tied or plaited or braided into a shape and a lower body section of rush stalks having a plain skirt or a pleated skirt, wherein both body sections are joined by means of a bar passing through support plates or by adhesive means.

10 Claims, 2 Drawing Sheets

DOLL OF RUSH STALKS

SUMMARY OF THE INVENTION

Present invention relates to a doll of rush stalks, in particular, integrating together a lower body section having a plain skirt or a peated skirt or a tiered flare skirt and an upper body section of any suitable form, or an upper body section of rush stalks tied or plaited or braided into a shape, by means of adhesive or by mediation of a support bar provided in and through support plates for a skirt. In prior arts, there have been introduced some rush stalk dolls having a single skirt in a straight drooped simple form or in a slightly flared form, but never have there been introduced any rush stalk dolls having a pleated skirt or a tiered flare skirt.

In putting a flare skirt of cloth on for a doll of a common body of stuffing and sewing or plastic resin or wood, it requires a support of wire or a strong and stiff starching of the skirt cloth to achieve the flare of the skirt. Such a doll has however a drawback of losing the effect of starching, that results in deforming of the skirt, after a long time of being.

Dolls of rush stalks, quite different from dolls of other materials, are made only by means of handcraft, and it requires long hours of inefficient works for putting on a pleated skirt or a tiered skirt.

An object of the present invention is to eliminate such a drawback and effect a solid appearance and facilitate fabrication.

BRIEF DESCRIPTION OF THE DRAWING

FIG. 5 shows the skirt in partial Section

Figure 3:
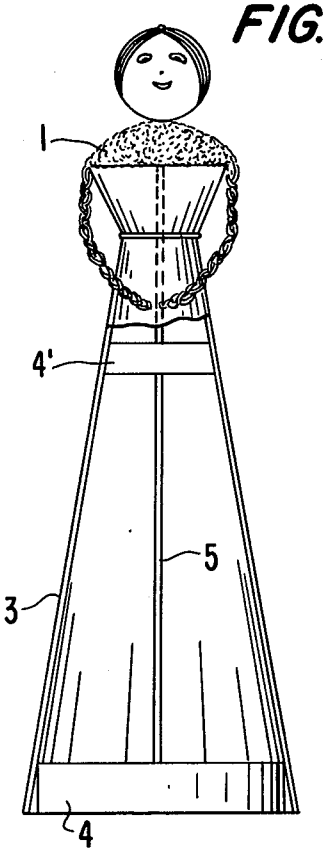
FIG. 3 shows a sectional view of another embodiment of the invention.

Numerals in the drawings indicate the following, 1 indicating an upper body, 2 a lacing, 3 a skirt, 4 and 4' support plates, 5 a support bar and 6 a head.

Referring to the drawings, the invention shall be described in detail.

DETAILED DESCRIPTION OF THE INVENTION

According to the invention, an upper body of the doll is made of rush stalks being tied, woven, braided or plaited in a shape, and a lower body section having a skirt 3 of rush stalks being, by means of laces 2, sewed together in a uniform arrangement to shape a plain skirt or a pleated skirt. For an assembled doll of the invention, the upper body 1 and the skirt 3 are joined for integration together with a head section 6 by means of adhesive as in the FIG. 1 or by means of a central support bar 5 provided through support plates 4 and 4' supporting the skirt 3 as in the FIGS. 2 and 3. In one embodiment of the invention, a plurality of flare skirts 3, 3' and 3" are supported coaxially on the central support bar 5 in the order of one over the other to form a tiered skirt section, as in the FIG. 4.

Figure 5:
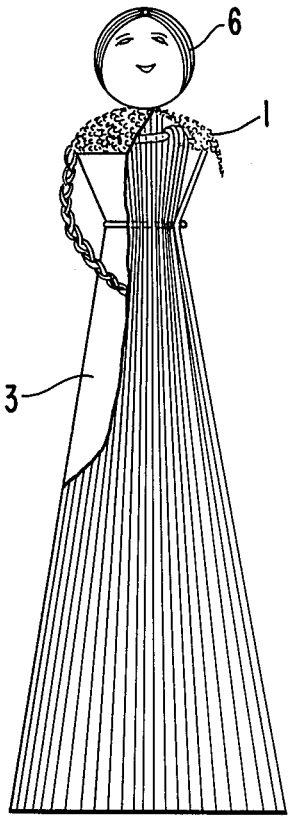

According to another embodiment of the invention, the skirt 3 has a solid inner support body of rush stalks being tied, plaited or woven and being joined for integration with a head 6 directly or through mediation of a separate upper body 1 in-between, as in the FIG. 5.

Figure 2:
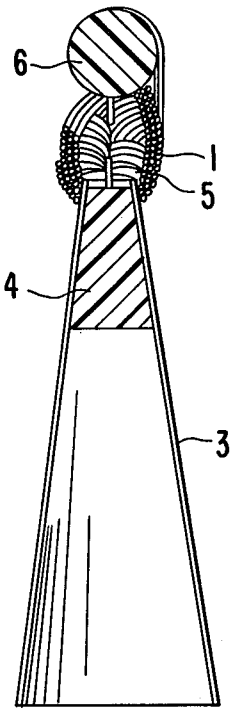
FIG. 2 shows a sectional view of an embodiment of the invention.
Figure 1:
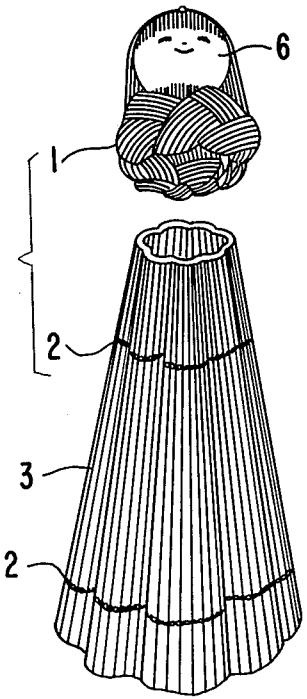
FIG. 1 shows a perspective view of separated sections of the invention.

Illustrating some of embodiments of invention, FIG. 1 shows an embodiment having a separate upper body 1 formed of rush stalks tied, plaited or woven and joined for integration at the bottom with a skirt 3 of plain lacing or pleat lacing. FIGS. 2 and 3 show other embodiments having a central support bar 5 provided protrudingly through a support plate 4 as in FIG. 2, or through support plates 4 and 4' as in FIG. 3, to join an upper body and a head 6 over it.

Figure 4:
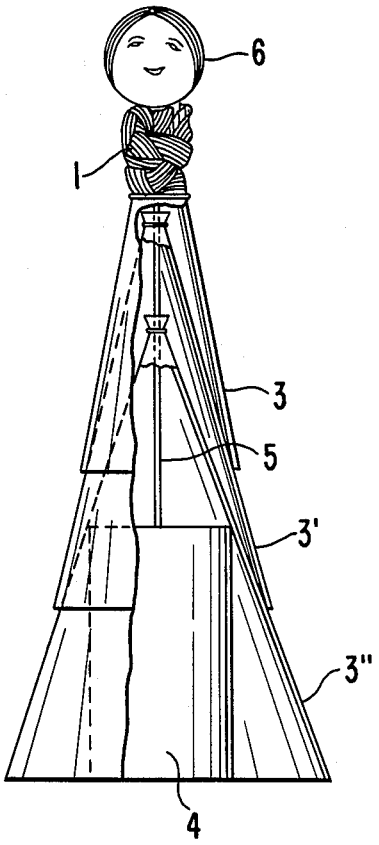
FIGS. 4 and 5 show front views of other embodiments of the invention

FIG. 4 shows another embodiment similar to the former ones in the FIG. 2 and 3 but having a plurality of skirts 3, 3' and 3" to pass the support bar 5 through and place them coaxially and overlappingly in the order of one over the other to form a tiered skirt section.

In FIG. 5, still other embodiment of the invention is shown with an upper body 1 of rush stalks plaited, woven or braided to be joined for integration with a solid skirt section 3 of rush stalks tied in middle or at the end portions. An advantage of the invention is a great improvement, in productivity of the manufacture employing solely handcrafts, that has been achieved by specializing production by sectional bodies, such as a head, an upper body, a skirt section and joining means of support plates and a support bar, to be assembled later for a complete doll.

Another advantage of the invention is that the specialized divisional production has also resulted in better quality of the products and in good saving of raw materials.

Other advantage of the invention is that the designs of pleat, flare and tier in the skirt have also resulted in ellegance and refinement and solidity in the appearance of the doll.

I claim:

1. A rush stalk doll comprising a head, an upper body section of rush stalks and a lower body section having a pleated rush stalk skirt, and means for joining the head and the upper and lower body sections coaxially.

2. A rush stalk doll according to claim 1, wherein the rush stalks of the upper body section are braided to form a shape.

3. A rush stalk doll according to claim 1, wherein the rush stalks of the lower body section are sewn together to form a pleated skirt.

4. A rush stalk doll according to claim 3, wherein the rush stalks of the upper body section are braided to form a shape.

5. A rush stalk doll according to claim 3, wherein the joining means comprises spaced support plates in the lower body section, and a relatively stiff bar adapted to be received in the support plates, and the head being placed over a free end of the bar.

6. A rush stalk doll according to claim 5, wherein the rush stalks of the upper body section are braided to form a shape.

7. A rush stalk doll according to claim 4, wherein the lower body section comprises a plurality of nested skirts to form a tiered shape.

8. A rush stalk doll according to claim 7, wherein the joining means comprises spaced support plates in the lower body section, and a relatively stiff bar adapted to be received in the support plates, and the head being placed over a free end of the bar.

9. A rush stalk doll comprising a head, an upper body section of rush stalks, and a lower, solid body section with an outer skirt of tied rush stalks, the lower body section being joined directly through the outer skirt with the upper body section.

10. A rush stalk doll according to claim 9, wherein the rush stalks of the uper body section are woven and have downwardly extending strands to cover the lower solid body section and to form an integral doll body.

* * * * *